US008491221B1

(12) United States Patent
Hedin

(10) Patent No.: US 8,491,221 B1
(45) Date of Patent: Jul. 23, 2013

(54) COMPACTING SCREED EXTENSION FOR PAVING

(75) Inventor: Sven N. Hedin, Doylestown, PA (US)

(73) Assignee: Asphalt Joint Compactor, LLC, Reading, PA (US)

( * ) Notice: Subject to any disclaimer, the term of this patent is extended or adjusted under 35 U.S.C. 154(b) by 0 days.

(21) Appl. No.: 13/288,197

(22) Filed: Nov. 3, 2011

(51) Int. Cl.
*E01C 19/22* (2006.01)
*E01C 19/00* (2006.01)

(52) U.S. Cl.
USPC ..... 404/96; 404/104; 404/118

(58) Field of Classification Search
USPC ..... 404/74, 87, 96, 98, 104, 118
See application file for complete search history.

(56) References Cited

U.S. PATENT DOCUMENTS 3,080,798 A * 3/1963 McCullough et al. ..... 404/96
3,702,578 A * 11/1972 Davin ..... 404/118
4,181,449 A * 1/1980 Lenker ..... 404/87
4,489,658 A * 12/1984 von Beckmann ..... 104/12
4,493,585 A * 1/1985 Axer ..... 404/102
5,924,819 A * 7/1999 Breidenbach ..... 404/96
6,238,134 B1 * 5/2001 Sovik ..... 404/72
6,273,636 B1 * 8/2001 Johanpeter ..... 404/104
6,283,672 B1 * 9/2001 Sovik ..... 404/72
7,287,931 B2 * 10/2007 Anibaldi et al. ..... 404/104
8,128,314 B2 * 3/2012 Buschmann et al. ..... 404/118
2010/0150650 A1 * 6/2010 Buschmann et al. ..... 404/82

* cited by examiner

*Primary Examiner* — Thomas B Will
*Assistant Examiner* — Abigail R Risic
(74) *Attorney, Agent, or Firm* — Miller Law Group, PLLC

(57) ABSTRACT

A screed extension is selectively connected to opposing sides of a paving screed used to lay a blacktop over large surfaces to create a wedge notch joint for merging with an adjacent swath of blacktop. The screed extension includes a positionable base plate that can be oriented at a selective depth relative to the screed. The base plate is connected to linear actuators through a gear box corresponding to opposing sides of the base plate to position the corresponding side of the base plate at a selected height to orient the base plate in a sloped configuration to form the wedge notch joint along a side of a course of blacktop. The base plate supports a vibration unit providing compaction to the wedge notch joint as the course of blacktop is being deposited, thus providing a dense joint between adjacent swaths of a course of blacktop.

18 Claims, 8 Drawing Sheets

10
12

14
35
35
11
11
26
9
13
25
8
25
30
30
16
16
15
15
35
35
11
11
37
37
20
21
23

Fig. 10
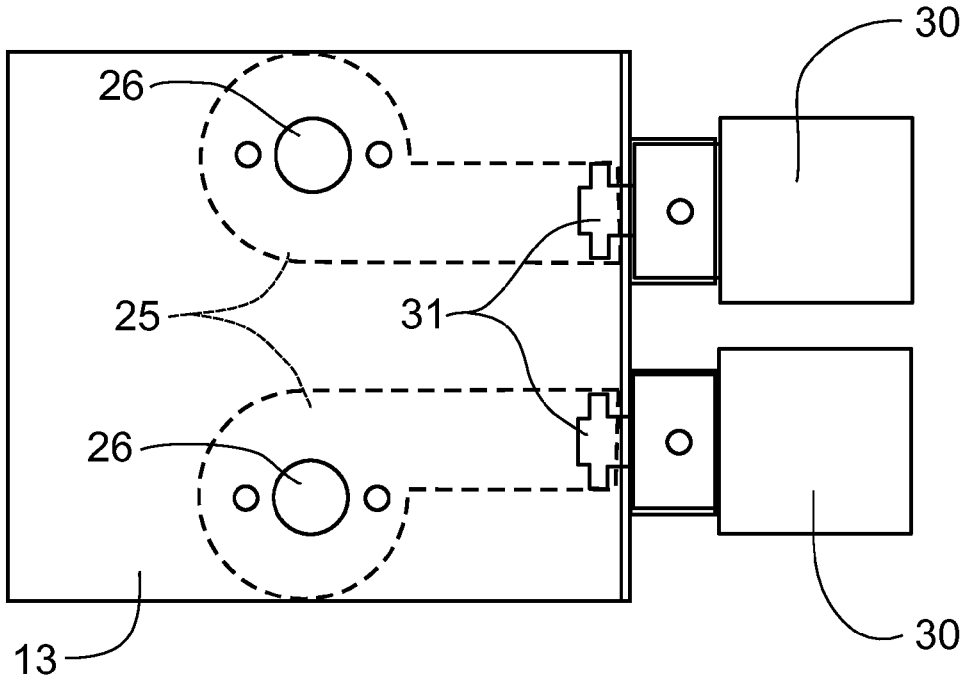
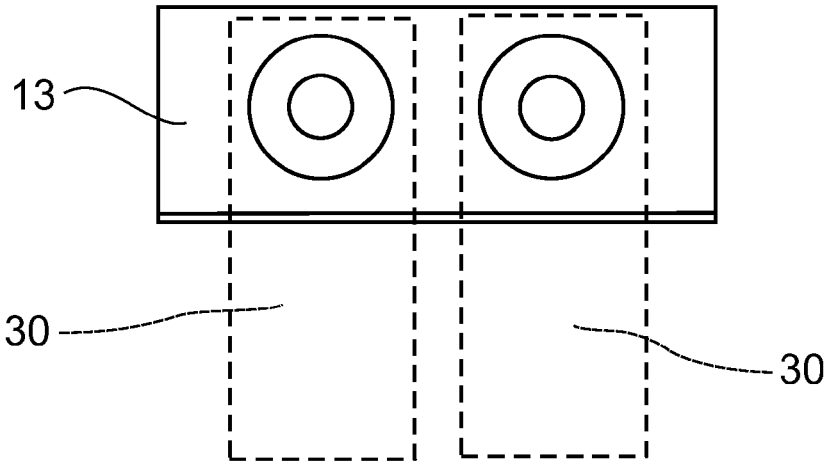
Fig. 11

Fig. 12
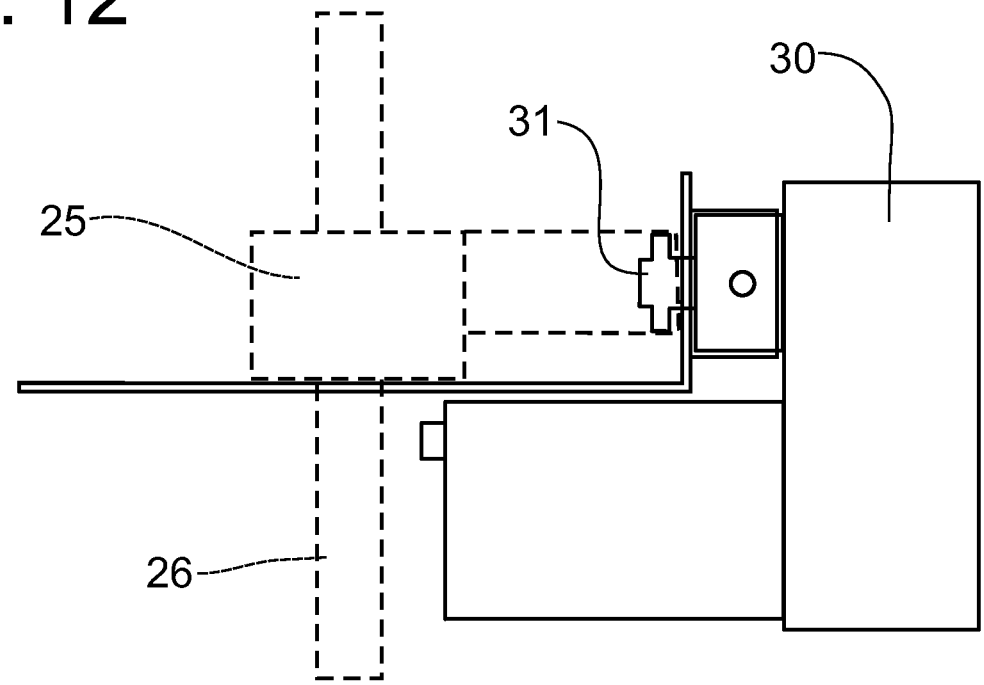
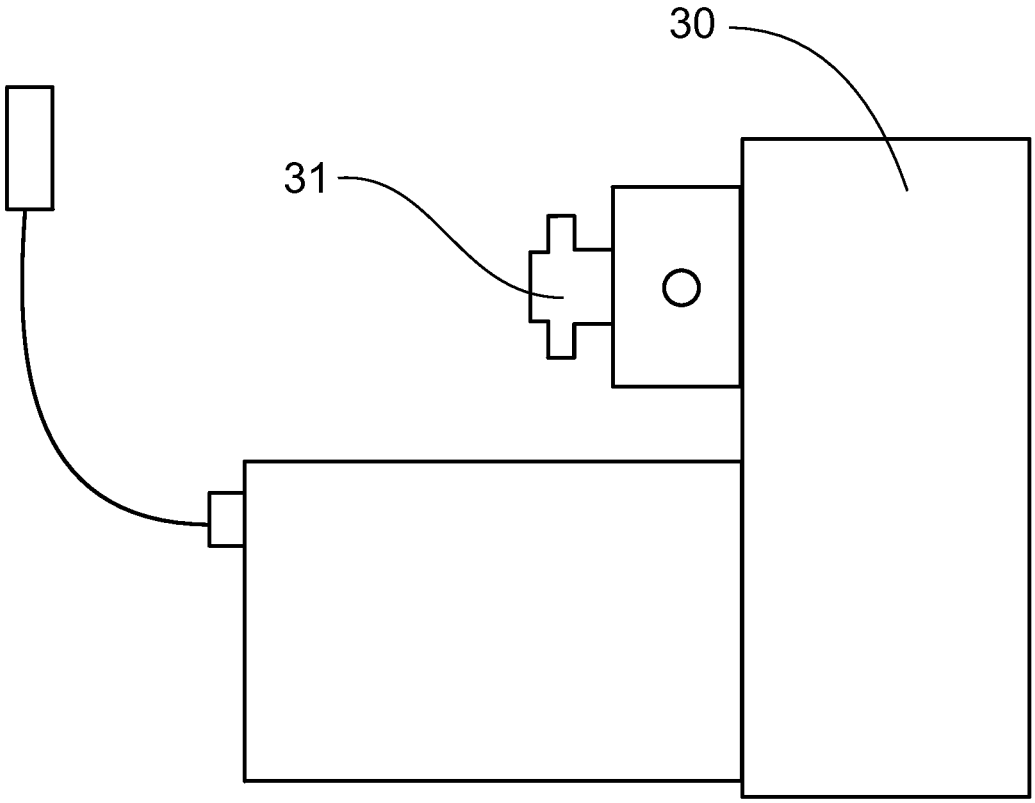
Fig. 13

COMPACTING SCREED EXTENSION FOR PAVING

FIELD OF THE INVENTION

The present invention relates generally to the paving of large surfaces, such as highways and parking lots, and, more particularly, to an extension for a screed that compacts a joint between paving swaths of bituminous concrete.

BACKGROUND OF THE INVENTION

Large surfaces to be paved require multiple passes of the paving apparatus, including a screed for leveling a layer of bituminous concrete, typically referred to as blacktop. The layer of blacktop along the edge of a paving swath against which a subsequent swath of blacktop is to be laid is typically formed with a joint to facilitate the joinder of the adjacent layers of blacktop. The joint is formed by a screed extension that is shaped into the desired joint configuration. Compaction of the bituminous concrete is accomplished primarily by motorized roller machines passing back and forth over the layer of blacktop previously laid. Motorized roller machines cannot roll over the joint portion of the blacktop layer as the compaction action would destroy the configuration of the joint.

Bituminous concrete is typically applied in layers, referred to as courses, with a base layer being deposited over a stone base or other support, followed by a wear course deposited over the top surface of the base course. The blacktop is trucked to a screed that deposits the blacktop in a course having a predetermined thickness. Since the screeds have a discrete width, large surfaces to be covered require two or more passes with the screed laying adjacent swaths of blacktop with each pass. As shown in FIG. 2, the wedge notch joint 2 is formed along a side of a swath 1 of blacktop for the merger of the adjacent swaths of blacktop and typically has a configuration specified by contract specifications. The wedge notch joint 2 is typically configured with an upper lip 3 defining an edge having a depth of perhaps one-half inch, the actual depth being determined by the size of aggregate being used in the blacktop being deposited as the height being at least the maximum size of the aggregate. The joint 2 then has a sloped portion 5 that extends from the upper lip 3 downwardly to a lower lip 7 that forms an edge having a height at least as great as the maximum size of the aggregate used in the course of blacktop being deposited in the adjacent swath.

This joint configuration provides for a smooth joinder of adjacent swaths of blacktop. Compaction of the joint area is accomplished after the adjacent layer of blacktop is deposited so that the motorized roller machine is run over top of the joinder area. The problem arises with the first swath of blacktop from which the joint is formed cures before the subsequent swath is applied on top of the joint and the motorized roller machines are ineffective to compact the cured joint on the first swath. When compaction tests are performed, the joint area is typically the primary locations at which the compaction tests fail.

It would be desirable to provide a screed extension that would be operable to form a joint for the merger of adjacent swaths of a blacktop course in the desired configuration, but with an ability to compact the joint area when the swath on which the joint is formed is deposited, and before the application of the adjacent swath of blacktop.

SUMMARY OF THE INVENTION

It is an object of this invention to overcome the disadvantages of the prior art by providing a screed extension that incorporates a compaction device to compact the joint area of a swath of a course of bituminous concrete.

It is another object of this invention to provide a screed extension that is selectively configurable to form a wedge notch joint area for the merger of adjacent swaths of a course of blacktop in multiple configurations.

It is a feature of this invention that the screed extension can be used on either the left side or the right side of a conventional screed machine to form a joint area on a swath of blacktop being deposited by the screed.

It is an advantage of this invention that the screed extension is selectively configurable to provide a joint area for the merger of adjacent swaths of blacktop on either side of a conventional screed in the desired joint configuration.

It is another feature of this invention that the screed extension includes a base plate that is supported on opposing lateral sides by linear actuators that are operable to locate the lateral edges of the base plate at a desired position relative to a frame of the screed extension.

It is another advantage of this invention that the selectively positionable base plate can be configured to form a desired wedge notch joint configuration on either side of the screed.

It is yet another feature of this invention that the base plate is formed for the mounting of a vibration unit that provides compaction operation for the base plate.

It is yet another advantage of this invention that the positionably configurable base plate forms the joint area and also provides compaction of the joint area prior to the application of a subsequent adjacent swath of blacktop.

It is still another advantage of this invention that the vibration unit can be powered either electrically or hydraulically.

It is a further advantage of this invention that the linear actuators can be powered electrically.

It is a further feature of this invention that the vertical positioning of the sides of the base plate is provided through operation of a gear box coupled to the linear actuator.

It is a further object of this invention to provide a screed extension for the formation of a wedge notch joint to facilitate the merger of adjacent swaths of a blacktop course, which is which is durable in construction, inexpensive of manufacture, carefree of maintenance, facile in assemblage, and simple and effective in use.

These and other objects, features and advantages are accomplished according to the instant invention by providing a screed extension selectively connected to opposing sides of a paving screed used to lay a blacktop over large surfaces to create a wedge notch joint for merging with an adjacent swath of blacktop. The screed extension includes a positionable base plate that can be oriented at a selective depth relative to the screed. The base plate is connected to linear actuators through a gear box corresponding to opposing sides of the base plate to position the corresponding side of the base plate at a selected height to orient the base plate in a sloped configuration to form the wedge notch joint along a side of a course of blacktop. The base plate supports a vibration unit providing compaction to the wedge notch joint as the course of blacktop is being deposited, thus providing a dense joint between adjacent swaths of a course of blacktop.

BRIEF DESCRIPTION OF THE DRAWINGS

The foregoing and other objects, features, and advantages of the invention will appear more fully hereinafter from a consideration of the detailed description that follows, in conjunction with the accompanying sheets of drawings. It is to be expressly understood, however, that the drawings are for illustrative purposes and are not to be construed as defining the limits of the invention.

FIG. 10 is a top plan view of the screed extension showing the mounting of the linear actuators to drive the gearboxes shown in phantom, which in turn are connected to the opposing sides of the base plate for positioning the base plate in a selected orientation for forming the wedge notch joint;

FIG. 11 is a front elevational view of the mounting plate for the support of the linear actuators and the corresponding gear boxes;

FIG. 12 is a side elevational view of the linear actuators mounted on the frame of the screed extension and being drivingly connected to the gearboxes shown in phantom to effect movement of the base plate according to the principles of the instant invention; and FIG. 13 is a side elevational view of the linear actuator.

DETAILED DESCRIPTION OF THE PREFERRED EMBODIMENT

Figure 1:
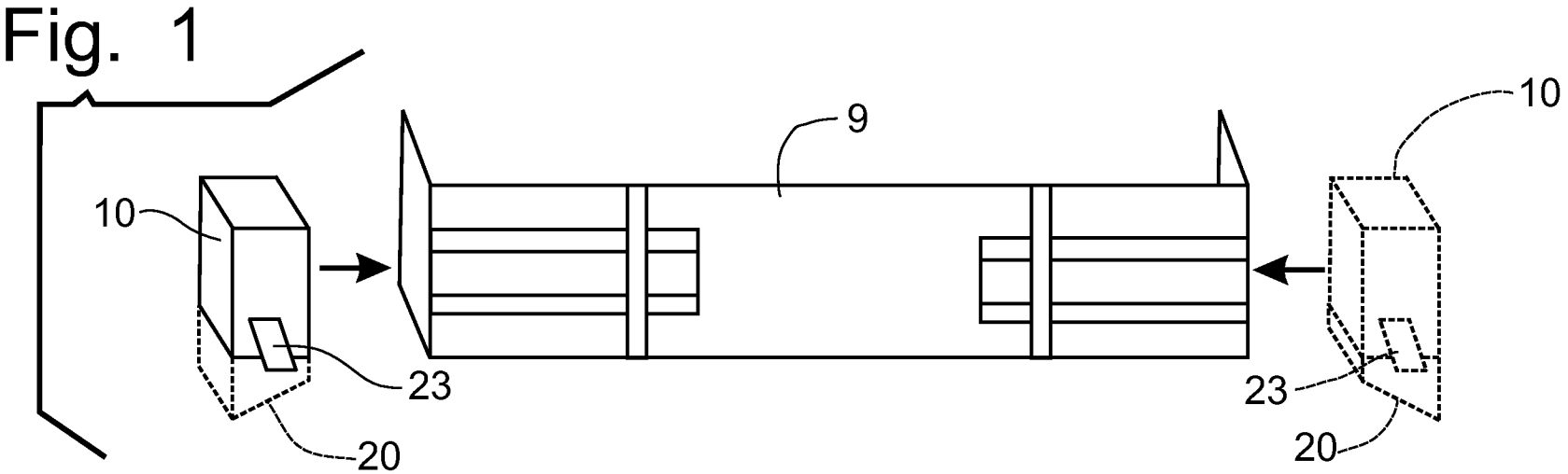
FIG. 1 is a schematic representative perspective view of a screed on which a screed extension incorporating the principles of the instant invention can be mounted, the screed extension being schematically shown on opposing sides of the screed with the positionable base plate being shown in phantom.
Figure 2:
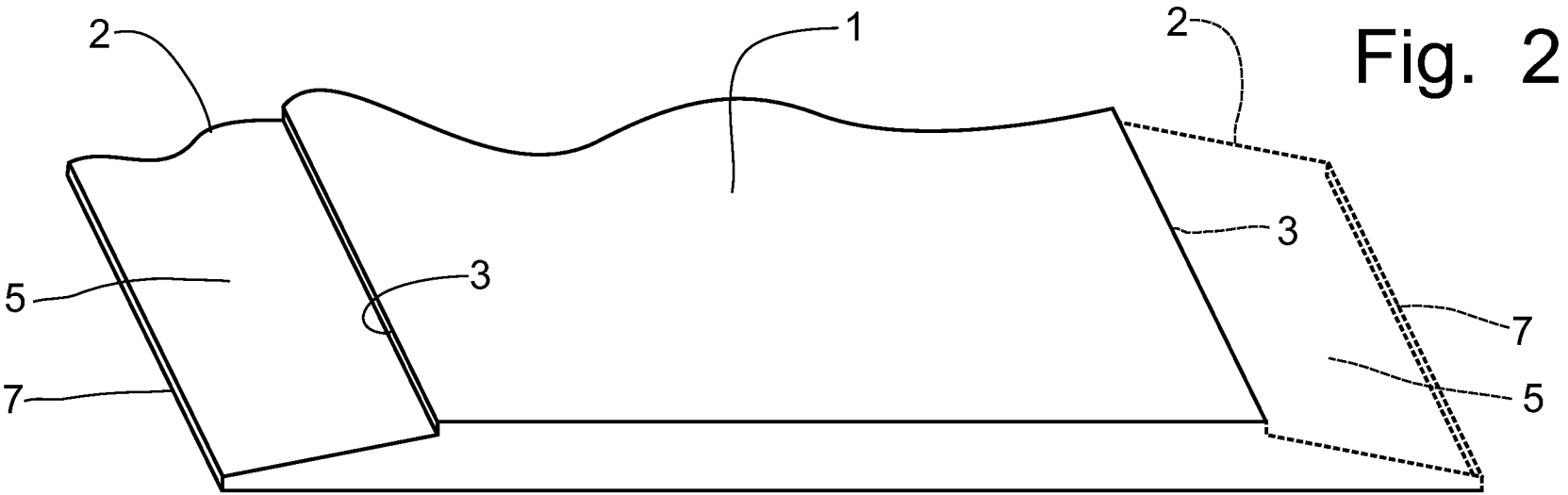
FIG. 2 is a perspective view of a swath of a course of blacktop having a wedge notch joint formed along one edge thereof, a representative wedge notch joint at the opposing side of the paving swath being shown in phantom.
Figure 3:
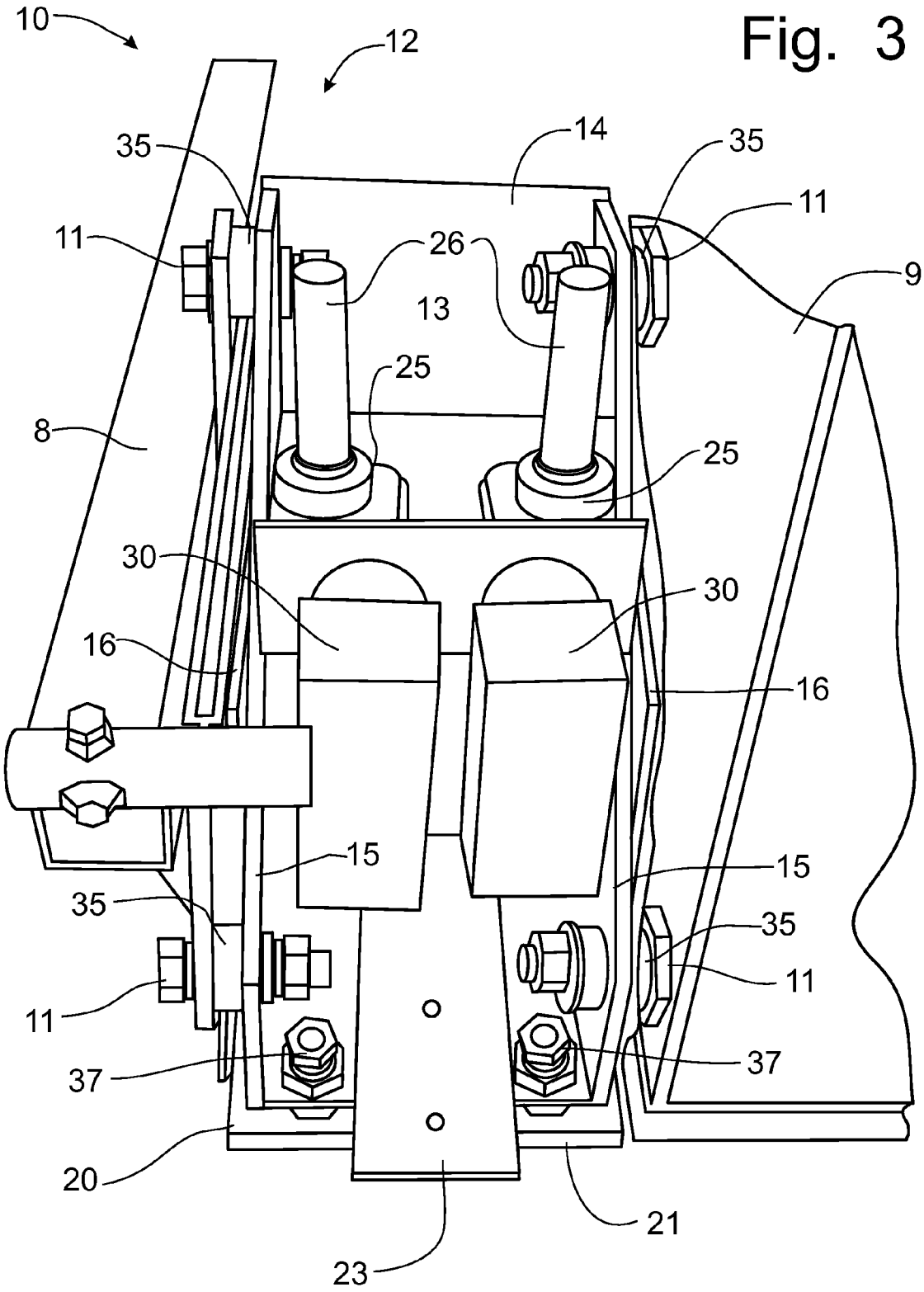
FIG. 3 is a perspective view of the screed extension incorporating the principles of the instant invention, the adjacent portion of the screed on which the screed extension is mounted being representatively shown though broken away for purposes of clarity.

Referring to FIGS. 1-4, a screed extension incorporating the principles of the instant invention can best be seen. The screed extension 10 is detachably mounted to the side of the paving screed 9 by fasteners 11 that secure the frame 12 of the screed extension 10 in a fixed position relative to the screed 9. The frame 12 is formed in a manner that the screed extension 10 is selectively mountable to the screed 9 on either side thereof. Thus, the screed extension 10 is operable as described in greater detail below to form a wedge notch joint 2 on either side of the swath 1 of blacktop being deposited to cover a surface.

The frame 12 of the screed extension 10 is formed with laterally opposing side sheets 15 that receive the fasteners 11 to secure the adjacent one of the side sheets 15 to the screed 9. The opposing side sheet 15 can be supported on a mounting arm 8 extending from the screed 9 to rigidly support the frame 12 of the screed extension 10 on the screed 9. The frame 12 also includes a gear box mounting plate 13 and a front plate 14 that are supported between the opposing side sheets 15 to define the screed extension frame 12. The screed extension 10 also includes a pair of opposing slide plates 16 formed with an upper portion 17 connected to a lower portion 19 by a hinge 18 allowing the lower portion 19 to pivot relative to the upper portion 17. The slide plates 16 are mounted in a laterally opposing orientation adjacent each of the respective side sheets 15. Preferably, the slide plates 16 are mounted on the outboard sides of the corresponding side sheets 15 to control the movement of the lower portions 19, as will be described in greater detail below.

Figure 4:
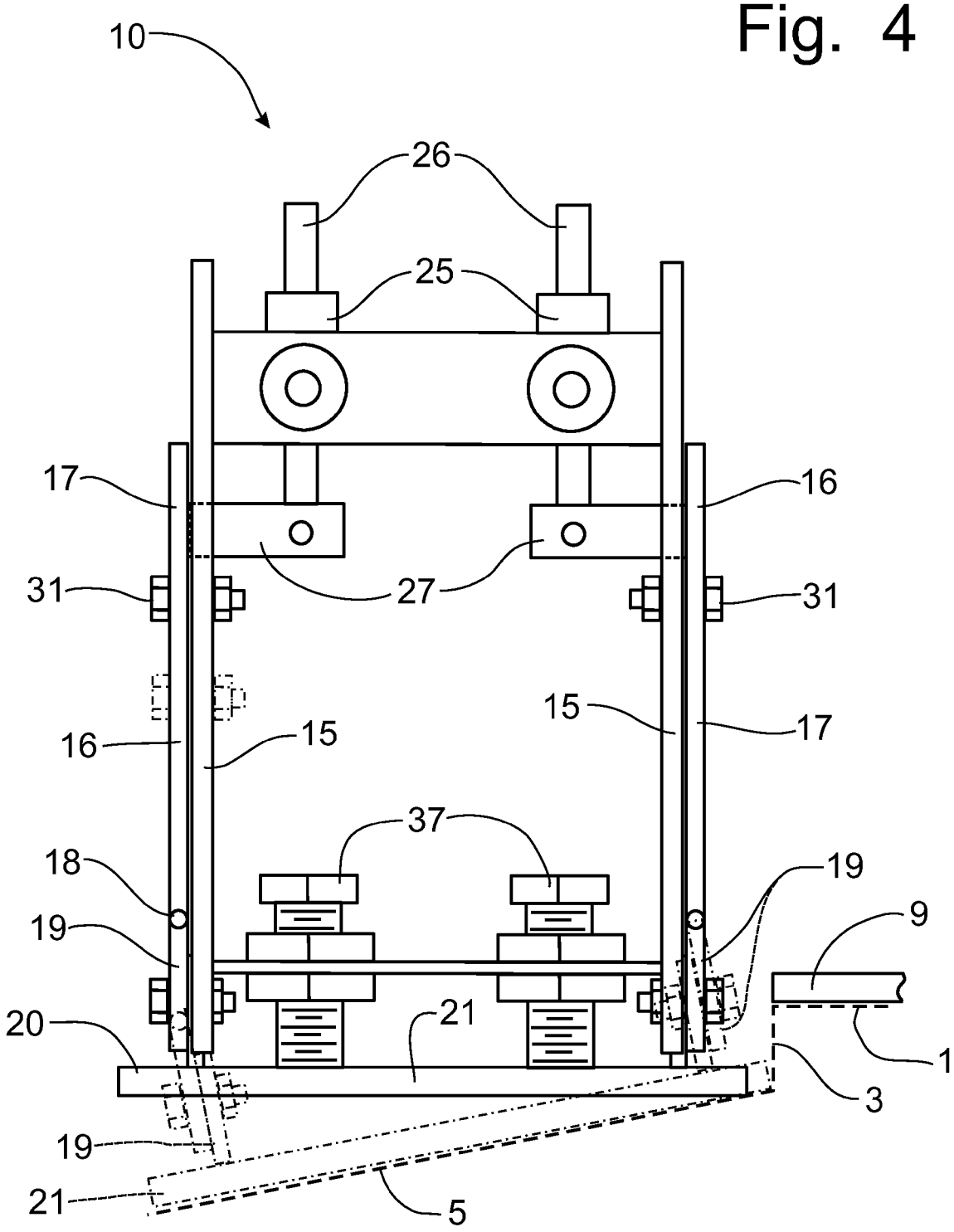
FIG. 4 is a front elevational view of the screed extension with the linear actuators and a portion of the base plate broken away to show the movement of the slide plates supporting the base plate for positioning in forming the wedge notch joint, the movement of the base plate and slide plates being shown in phantom.
Figure 6:
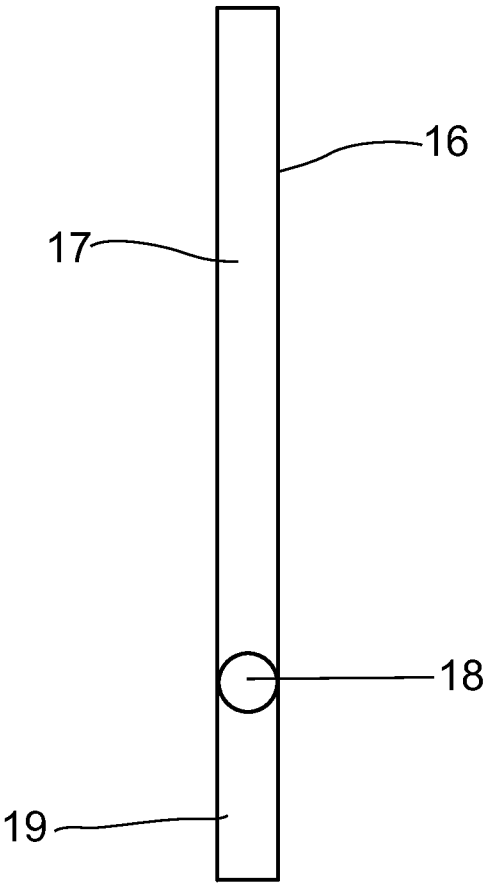
FIG. 6 is an end view of the slide plate shown in FIG. 5 with movement of the lower hinged portion being shown in phantom.
Figure 5:
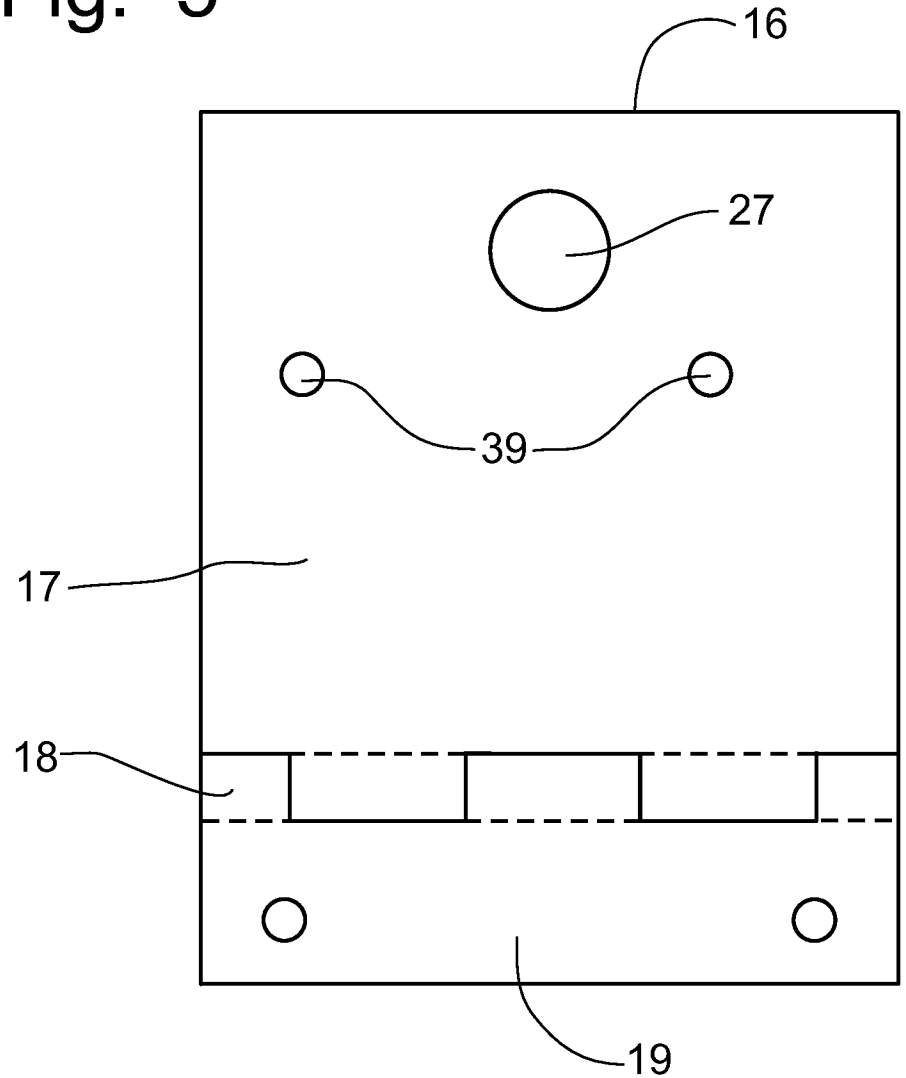
FIG. 5 is an elevational view of a slide plate.
Figure 7:
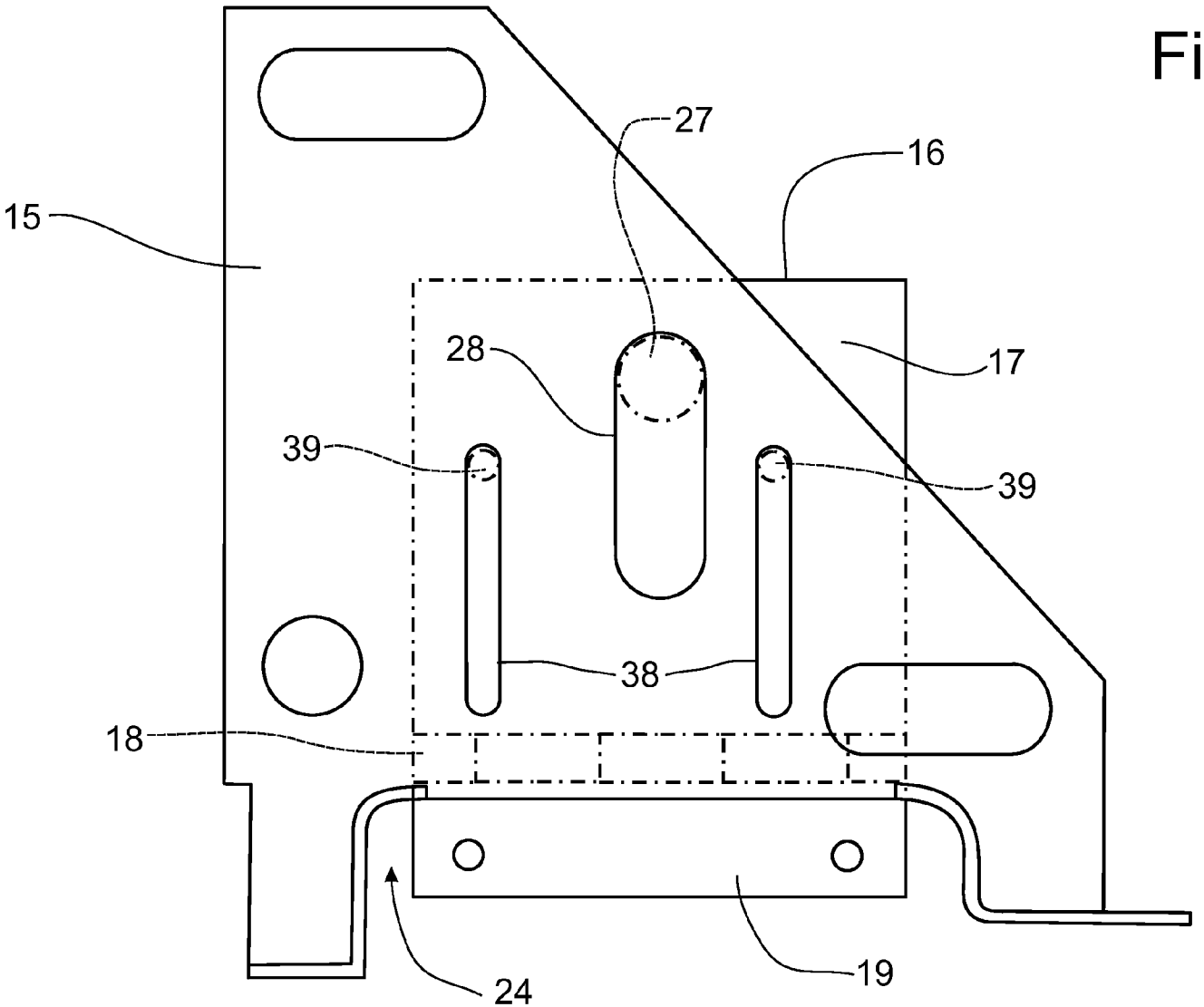
FIG. 7 is an elevational view of a side sheet forming part of the frame of the screed extension, the mounting of a slide plate thereon being shown in phantom.
Figure 8:
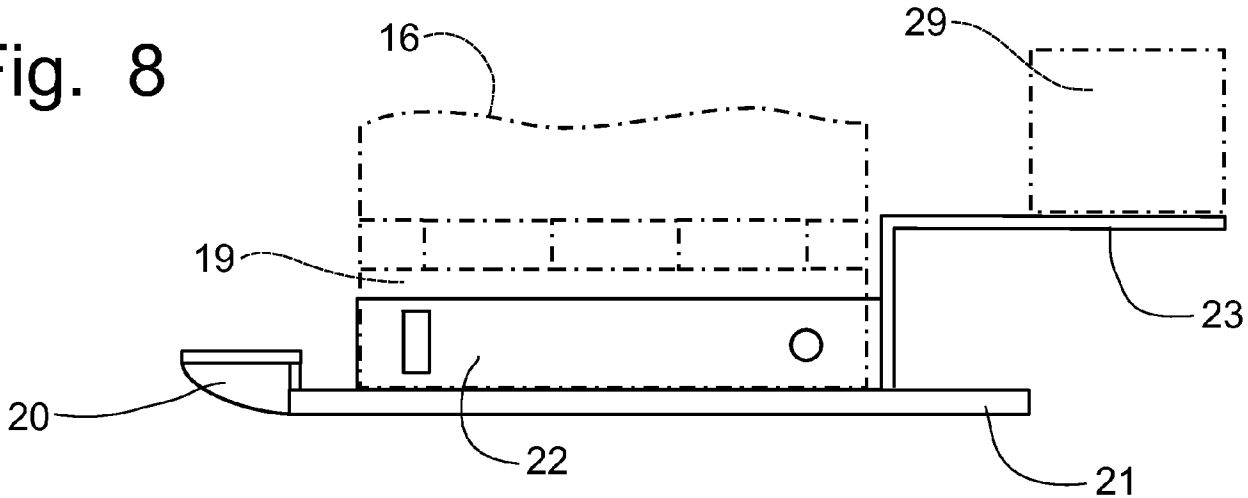
FIG. 8 is a side elevational view of the base plate, the connection thereof to a slide plate and the mounting of a vibration unit thereon being shown in phantom.
Figure 9:
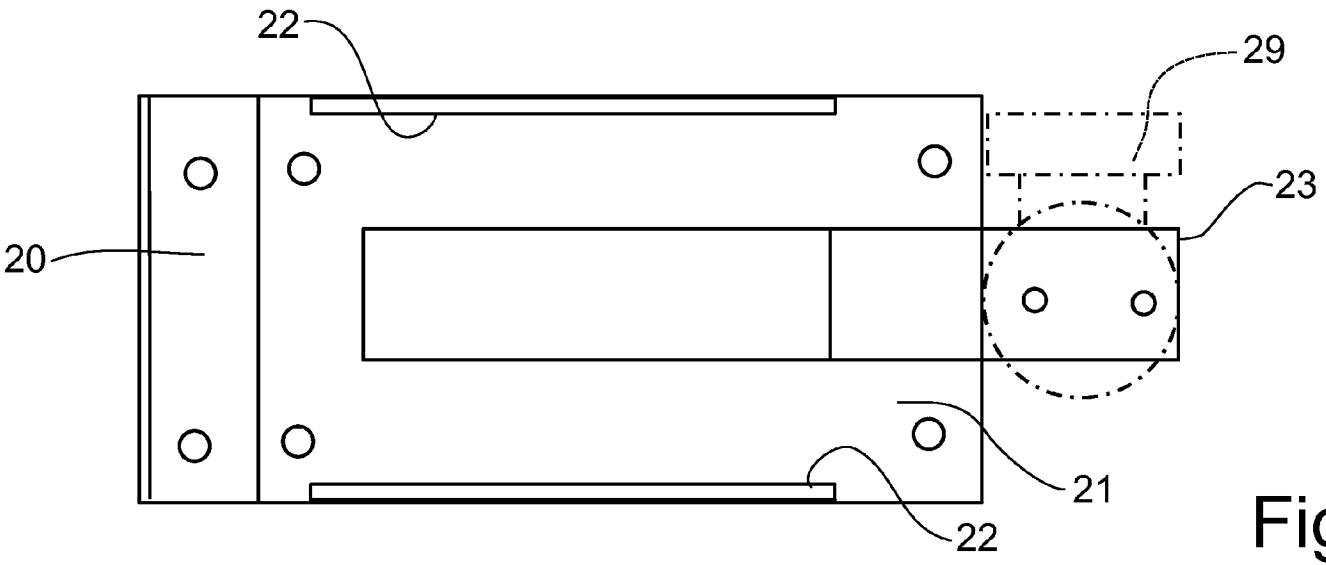
FIG. 9 is a top plan view of the base plate as shown in FIG. 8, the mounted vibration unit being shown in phantom.

Referring now to FIGS. 3, 4, 8 and 9, a base plate 20 is supported between the side sheets 15 from the lower portions 19 of the slide plates 16. The base plate 20 includes a flat leveling portion 21 spanning the lateral distance between the slide plates 16. The leveling portion 21 includes perpendicular mounting tabs 22 on opposing lateral sides thereof for connection of the base plate 20 to the respective lower portions 19 of the slide plates 15. As is best seen in FIGS. 4 and 7, the side sheets 15 are formed with a central cutout 24 that permits the connection of the mounting tabs 22 to the lower portions 19 while the base plate 20 is located between the side sheets 15 and the slide plates 16 are located outboard of the side sheets 15. Furthermore, the slide plates 16 are oriented with respect to the side sheets 15 such that the hinges 18 are located above the central cutout 24, when in the upper most position, to limit the movement of the lower portions 19 inboard of the side sheets 15, as will be described in greater detail below. The base plate 20 also includes a central support member 23 projecting upwardly and outwardly of the leveling portion 21 to provide for the mounting of a vibration unit 29, shown in phantom in FIGS. 8 and 9.

As is best seen in FIGS. 3, 4 and 10-13, the gearbox mounting plate 13 is horizontally oriented between the side sheets 15 for the support of a pair of worm gear boxes 25, each gearbox 25 having a vertically oriented positioning shaft 26 extending above and below the respective gearboxes 25. Each positioning shaft 26 is connected to the upper portion 17 of a corresponding slide plate 16 by a connecting fastener 27 passing through a vertical slot 28 formed in the side sheet 15 for the passage of the connecting fastener 27 between the positioning shaft 26 and the slide plate 16. The gearboxes 25 are rotatable independently so that a rotation of each gearbox 25 causes a vertical movement of the positioning shaft 26 which is transferred to the slide plate 16 to move the slide plate 16 vertically relative to the corresponding side sheet 15.

Consequently, the vertical movement of the slide plate 16 is transferred to the mounting tab 22 on the base plate 20 to cause a corresponding side of the base plate 20 to move vertically. Since each gearbox is operable independently, the respective movements of the sides of the base plate 20 will angle the base plate 20 into a desired orientation to form the requisite wedge notch joint 2. A linear actuator 30 is mounted on the gearbox mounting plate 13 for driving connection to each of the worm gearboxes 25. Each linear actuator 30 is preferably electrically powered, although the actuators 30 could be hydraulically operated as well. Each linear actuator 30 includes a drive member 31 coupled to the worm gear box to operate the corresponding gear box independently to allow the selective positioning of the base plate 20 in a desired manner for creating the wedge notch joint 2.

In operation, the screed extension 10 is mounted onto the side of the screed 9 on which the formation of a wedge notch joint 2 along the edge of the swath of paving 1 is desired by securing the frame 12 of the screed extension 10 to the side of the screed 9 by the fasteners 11. Prior to starting the paving operation, the base plate 20 is properly oriented by activating the respective linear actuators 30 to lower the corresponding sides of the base plate 20. Typically, the side of the base plate 20 closest to the screed 9 will only be positioned downwardly about a half of an inch to form the upper lip 3 relative to the paving swath 1. The opposing side of the base plate 20 is then lowered sufficiently to orient the base plate 20 at the required angle to form the sloped portion 5, and to be spaced above the surface being paved a distance of about a half of an inch to form the lower lip 7. Once the base plate 20 is properly oriented, the blacktop material can be placed into the screed 9 and the screed extension 10 to lay a swath of paving while forming the wedge notch joint 2 with the screed extension 10.

The mounting of the vibration unit 29 on the support member 23 causes the paving material on the sloped portion 5 beneath the base plate 20 to be compacted. The oscillatory vibration exerted by the vibration unit 29 causes the base member to vibrate, which is transmitted to the paving material along the sloped portion 5. Preferably, elastomeric members 35 are used with the fasteners 11 connecting the screed extension 10 to the side of the screed 9 and to the mounting arm 8 to isolate the vibration within the screed extension 10. Adjuster screws 37 supported from horizontal portions of the side sheets 15 can be used to define the maximum raised position of the base plate 20, which in turn defines the depth of the lip 3 in the wedge notch joint 2. If the screed extension 10 is to be used to simply extend the operative width of the screed 9 without forming the wedge notch joint 2, the adjuster screws 37 can be raised to position the base plate 20 in alignment with the screed 9.

The movement of the slide plates 16 is best seen in FIGS. 4-8. The vertical positioning shaft 26 of the gearboxes 25 is connected to the connecting fastener 27 that passes through the slot 28 formed within the side sheets 15. Movement of the slide plates 16 is restricted to being vertical in nature by the utilization of guide pins 39 passing through parallel slots 38. The slide plate 16 is oriented on the corresponding side sheet 15 when in the maximum raised position so that the lower portion 19 is located within the central cutout portion 24, thus enabling the connection of the mounting tabs 22 of the base plate 20 to the lower portion 19 of the slide plate 16 with the side sheet 15 located inboard of the slide plate 16. The hinge 18 is located above the central cutout portion 24 behind the side sheet 15, as is represented in FIG. 7, so that the lower portion 19 of the slide plate 16 cannot pivot inwardly when placed into the maximum raised position.

When the linear actuator 30 is manipulated to lower the outboard side of the base plate 20, the hinge 18 lowers into alignment with the central cutout portion 24, thus clearing the lower portion 19 to pivot inwardly relative to the corresponding side sheet 15, as is depicted in FIG. 4. In this manner, the base plate 20 is capable of angling in an orientation that will form the sloped portion 5 of the wedge notch joint 2 in the desired manner. When both sides of the base plate 20 are moved into the maximum raised position, as shown in solid lines in FIG. 4, the base plate 20 cannot pivot on the slide plates 16 as one side sheet 15 prevents movement in one direction and the opposing side sheet 15 prevents movement in the opposite direction.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiments of the invention; however, concepts, as based upon the description, may be employed in other embodiments without departing from the scope of the invention. The invention is not otherwise limited, except for the recitation of the claims set forth below.

Having thus described the invention, what is claimed is:

1. A screed extension for mounting on a screed member to deposit a layer of bituminous concrete over a surface, comprising:

a frame detachably connectable to said screed, said frame including a pair of laterally opposing side sheets;

a pair of laterally opposed slide plates respectively supported for vertical movement on said side sheets, each said slide plate being formed with an upper portion and a lower portion pivotally connected to said upper portion so that said lower portion is pivotally movable relative to said upper portion;

a base plate including a leveling portion connected to said slide plates, said base plate spanning between said slide plates and being vertically movable with said slide plates; and an actuating mechanism connected to said slide plates to control vertical movement of said base plate.

2. The screed extension of claim 1 wherein said base plate includes a support member mounting a vibration unit.

3. The screed extension of claim 2 wherein said actuating mechanism includes a pair of linear actuators mounted for independent operation to raise and lower a respective lateral side of said base plate.

4. The screed extension of claim 3 wherein said actuating mechanism further includes a gearbox interconnecting each said linear actuator with a corresponding slide plate.

5. The screed extension of claim 1 wherein each said side sheet is formed with a central cutout portion alignable with the lower portion of the corresponding said slide plate connected to a mounting tab affixed to the corresponding side of said base plate.

6. The screed extension of claim 5 wherein each said slide plate is mounted on an outboard side of the corresponding said side sheet, each said side sheet being formed with a first slot for the passage of a connecting fastener interconnecting a vertical positioning shaft associated with the corresponding gearbox with the upper portion of the corresponding slide plate.

7. The screed extension of claim 6 wherein each said side sheet is further formed with at least one guide slot cooperable with a corresponding guide pin mounted on the corresponding upper portion of the adjacent slide plate.

8. The screed extension of claim 7 wherein each said side sheet is connected to said screed by fasteners having elastomeric members that isolate vibrations from the vibration unit within the screed extension.

9. A screed extension for mounting on a screed member to deposit a layer of bituminous concrete material over a surface, comprising:

a frame detachably connectable to said screed, said frame including a pair of laterally opposing side sheets;

a pair of laterally opposed slide plates respectively supported for vertical movement on said side sheets, each said slide plate being formed with an upper portion and a lower portion connected by a hinge to said upper portion so that said lower portion is pivotally movable relative to said upper portion;

a base plate including a leveling portion connected to said slide plates and a support member connected to said leveling portion, said leveling portion spanning between said slide plates and being vertically movable with said slide plates; and a vibration unit mounted on said support member for compacting bituminous concrete material beneath said leveling portion.

10. The screed extension of claim 9 further comprising an actuating mechanism connected to said slide plates to control vertical movement of said base plate.

11. The screed extension of claim 10 wherein said actuating mechanism includes a pair of linear actuators mounted for independent operation to raise and lower a respective lateral side of said base plate, each said linear actuator being connected to a gearbox formed with a vertical positioning shaft connected to the corresponding said slide plate.

12. The screed extension of claim 9 wherein each said side sheet is formed with a central cutout portion alignable with the lower portion of the corresponding said slide plate connected to a mounting tab affixed to the corresponding side of said base plate, each said hinge being located above the central cutout portion when the slide plate is positioned in a maximum raised position, each said slide plate being mounted on an outboard side of the corresponding said side sheet to restrict movement of each corresponding said lower portion inwardly of said side sheet when said slide plate is in said maximum raised position.

13. The screed extension of claim 12 wherein each said side sheet is formed with a first slot for the passage of a connecting fastener interconnecting the associated said vertical positioning shaft and with at least one guide slot cooperable with a corresponding guide pin mounted on the corresponding upper portion of the adjacent slide plate to restrict the movement of said slide plate in a vertical direction.

14. A screed extension for mounting on a screed member to deposit a layer of bituminous concrete material over a surface, comprising:

a frame detachably connectable to said screed, said frame including a pair of laterally opposing side sheets;

a pair of laterally opposed slide plates respectively supported for vertical movement on said side sheets, each said slide plate including an upper portion and a lower portion connected to said upper portion by a hinge so that said lower portion is pivotally movable relative to said upper portion;

a base plate including a leveling portion, mounting tabs on the lateral sides of said leveling portion and a support member connected to said leveling portion, said lower portions of said slide plates being connected to the corresponding said mounting tabs so that said opposing sides of said base plate are vertically movable with said slide plates;

a vibration unit mounted on said support member for compacting bituminous concrete material beneath said leveling portion; and an actuating mechanism connected to said slide plates to control vertical movement of said base plate.

15. The screed extension of claim 14 wherein said actuating mechanism includes a pair of linear actuators mounted for independent operation to raise and lower a respective lateral side of said base plate, each said linear actuator being connected to a gearbox formed with a vertical positioning shaft connected to the upper portion of the corresponding said slide plate.

16. The screed extension of claim 15 wherein each said side sheet is formed with a central cutout portion alignable with the lower portion of the corresponding said slide plate, each said hinge being located above the central cutout portion when the slide plate is positioned in a maximum raised position, each said slide plate being mounted on an outboard side of the corresponding said side sheet to restrict movement of each corresponding said lower portion inwardly of said side sheet when said slide plate is in said maximum raised position.

17. The screed extension of claim 16 wherein each said side sheet is formed with a first slot for the passage of a connecting fastener interconnecting the associated said vertical positioning shaft and with at least one guide slot cooperable with a corresponding guide pin mounted on the corresponding upper portion of the adjacent slide plate to restrict the movement of said slide plate in a vertical direction.

18. The screed extension of claim 16 wherein each said slide plate is movable below said maximum raised position to position said hinge of each said slide plate in alignment with said central cutout portion to allow pivotal movement of the corresponding lower portion both inboard and outboard relative to said side sheet.

* * * * *